United States Patent [19]

Shimomura et al.

[11] Patent Number: 4,979,481

[45] Date of Patent: Dec. 25, 1990

[54] CONTROL APPARATUS FOR INTERNAL COMBUSTION ENGINE

[75] Inventors: Setsuhiro Shimomura; Seiji Wataya, both of Himeji, Japan

[73] Assignee: Mitsubishi Denki Kabushiki Kaisha, Tokyo, Japan

[21] Appl. No.: 411,286

[22] Filed: Sep. 22, 1989

[30] Foreign Application Priority Data

Sep. 24, 1988 [JP] Japan ..... 63-239514

[51] Int. Cl.[5] ..... F02D 41/22

[52] U.S. Cl. ..... 123/481; 123/489; 123/198 DB

[58] Field of Search ..... 723/198 DB, 436, 479, 723/481, 489, 630

[56] References Cited

U.S. PATENT DOCUMENTS

| | | | |
|---|---|---|---|
| 4,006,718 | 2/1977 | Konomi | 123/489 |
| 4,499,876 | 2/1985 | Yamamoto | 123/481 X |
| 4,886,029 | 12/1989 | Lill et al. | 123/630 X |

FOREIGN PATENT DOCUMENTS

| | | | |
|---|---|---|---|
| 0226245 | 12/1984 | Japan | 123/481 |
| 0023876 | 2/1986 | Japan . | |
| 0295841 | 12/1988 | Japan | 123/481 |

*Primary Examiner*—Willis R. Wolfe

*Attorney, Agent, or Firm*—Sughrue, Mion, Zinn, Macpeak and Seas

[57] ABSTRACT

A control apparatus for an internal combustion engine has cylinders each of which is provided with an exclusive fuel injection valve individually driven their openings. Each cylinder has a misfiring detecting means for detecting misfiring of that cylinder. The control apparatus includes a drive stopping means for stopping the driving of the fuel injection valve corresponding to a misfired cylinder so as to stop fuel supply to that misfired cylinder. The apparatus is further provided an air-to-fuel ratio sensor in the exhaust path of the engine so that when misfiring of the cylinder is detected, the fuel injection valves remain controlled through a feedback control where the openings of the normally fired cylinders are controlled in accordance with the air-to-fuel ratio signal outputted from the air-to-fuel ratio sensor in such a way that the apparent air-to-fuel ratio of the cylinders is given by an equation $L=nLo/(n-p)$ where L is the apparent value of the air-to-fuel ratio of the cylinders when p cylinders are misfired, n is the number of cylinders, Lo is the air-to-fuel ratio of the cylinders when all of the cylinders are normally operating, and p is the number of misfired cylinders.

3 Claims, 3 Drawing Sheets

CONTROL APPARATUS FOR INTERNAL COMBUSTION ENGINE

BACKGROUND OF THE INVENTION

1. Field of the Invention

The present invention relates to an internal combustion engine having an individually controlled fuel injection valve for each cylinder, and more particularly to a control apparatus for an internal combustion engine for preventing contamination of exhausted gas when some of the cylinders are misfired.

2. Prior Art

Various means for preventing the exhaust gas of an internal combustion engine from being contaminated have been known. Fuel injection methods for internal combustion engines of automobiles include the multi-point method in which the fuel is simultaneously supplied to the respective cylinders by means of a single fuel injection valve provided upstream of a branch point of an inlet manifold and the multi-point method in which each cylinder is individually supplied with fuel by means of an exclusive fuel injection valve. Trend is that a multi-point method injection pump is commonly employed as a useful means in a fuel system. The multi-point method is advantageous in distributing the fuel to the respective cylinders as compared to the single point method. The multi-point method is of a construction in which the fuel is injected to the intake port of the associated cylinder, and therefore very little amount of fuel is deposited to the wall surface of the manifold, ensuring clean exhaust gas as well as good control effect.

With the multi-point fuel injection pump, the excellent performance thereof permits clean exhaust gas to be exhausted while it is normally operating. However, when any one of the cylinders is misfired due to abnormal conditions in the engine, the fuel system, or the firing system, a large amount of unburned gas mixture is exhausted to cause increased environmental contamination.

In the case where the engine for the automobiles is provided with a catalyst converter in the exhaust system for purging the exhaust gas, the unburned air-fuel mixture contacts with the catalyst to cause oxidation of the gas, which in turn causes an increase in temperature of the catalyst. Particularly, if only one of a plurality of cylinders is misfired, the driver may not become aware of the misfiring, in which case not only the exhausted gas is extremely contaminated but also the temperature of the catalyst increases to an unusual point. This is a potential danger that may damage the catalyst.

To eliminate the problem described above, for example, Japanese Laid Open Patent Publication No. 61-23876 discloses a misfiring detecting method in which pressure sensors are disposed in the combustion chambers to detect and indicate misfiring by comparing the combustion pressures at two angular positions of a crank immediately before and after the top dead center of compression stroke.

The prior art method disclosed in Japanese Laid Open Patent No. 61-23876 is directed only to detecting and indicating the misfiring. Thus the rise in temperature of the catalyst and exhaust of unburned air-fuel mixture cannot be prevented unless the engine is immediately stopped. The automobile may continue to be driven till it arrives at a repair shop even though the misfiring is indicated to the driver for warning. The contamination of environment and overheat and damage of the catalyst during the trip to the repair shop remain unsolved.

SUMMARY OF THE INVENTION

The present invention has been made for eliminating the described drawbacks of the prior art apparatus. An object of the invention is to provide a control apparatus in which the fuel supply is discontinued to prevent the misfired air-fuel mixture from being exhausted when any one of the cylinders is misfired, so that the remaining cylinders permit the vehicle to normally run with clean exhaust gas being discharged.

A control apparatus for an internal combustion engine according to the present invention employs the so-called multi-point method having an exclusive fuel injection valve for each cylinder. The control apparatus comprises a misfiring detecting means provided at each cylinder for detecting misfiring of that cylinder, and a drive stopping means for stopping the driving of the fuel injection valve associated with that misfired cylinder.

For controlling the remaining cylinders to normally operate with a suitable air-to-fuel ratio while the fuel supply to the misfired cylinder is discontinued, the driving of the fuel injection valve associated with the misfired cylinder is advantageously stopped while at the same time feedback correction for the remaining cylinders may conveniently be carried out in accordance with the output of an air-to-fuel ratio sensor such as an oxygen sensor.

BRIEF DESCRIPTION OF THE DRAWINGS

Features and other objects of the present invention will be more apparent from the description of preferred embodiments with reference to the accompanying drawings in which.

DESCRIPTION OF PREFERRED EMBODIMENTS

Operation

In an open loop control, when a misfiring detecting means detects misfiring of a corresponding cylinder, a drive stopping means stops the driving of the fuel injection valve associated with that misfired cylinder. The fuel injection valves for the remaining cylinders are continued to be driven in accordance with the air intake and engine speed, the fuel injection demanded by the driver.

In a feedback loop control, when a misfiring detecting means detects misfiring of a corresponding cylinder, a drive stopping means stops the driving of the fuel injection valve associated with that misfired cylinder. The fuel injection valves for the remaining cylinders are continued to be driven in accordance with the air intake and engine speed, while also continuing to be driven through a feedback control where the opening of the normally fired cylinders are controlled in accordance with the air-to-fuel ratio signal outputted from the oxygen sensor in such a way that the apparent value of the air-to-fuel ratio of the cylinders is given by a equation $L=nLo/(n-p)$ where L is the apparent air-to-fuel ratio of the cylinders when p cylinders are misfired, n is the number of cylinders, Lo is the air-to-fuel ratio of the cylinders when all of the cylinders are normally operating, and p is the number of misfired cylinders.

Embodiment

A first embodiment of the invention will now be described with reference to the drawings.

Figure 1:
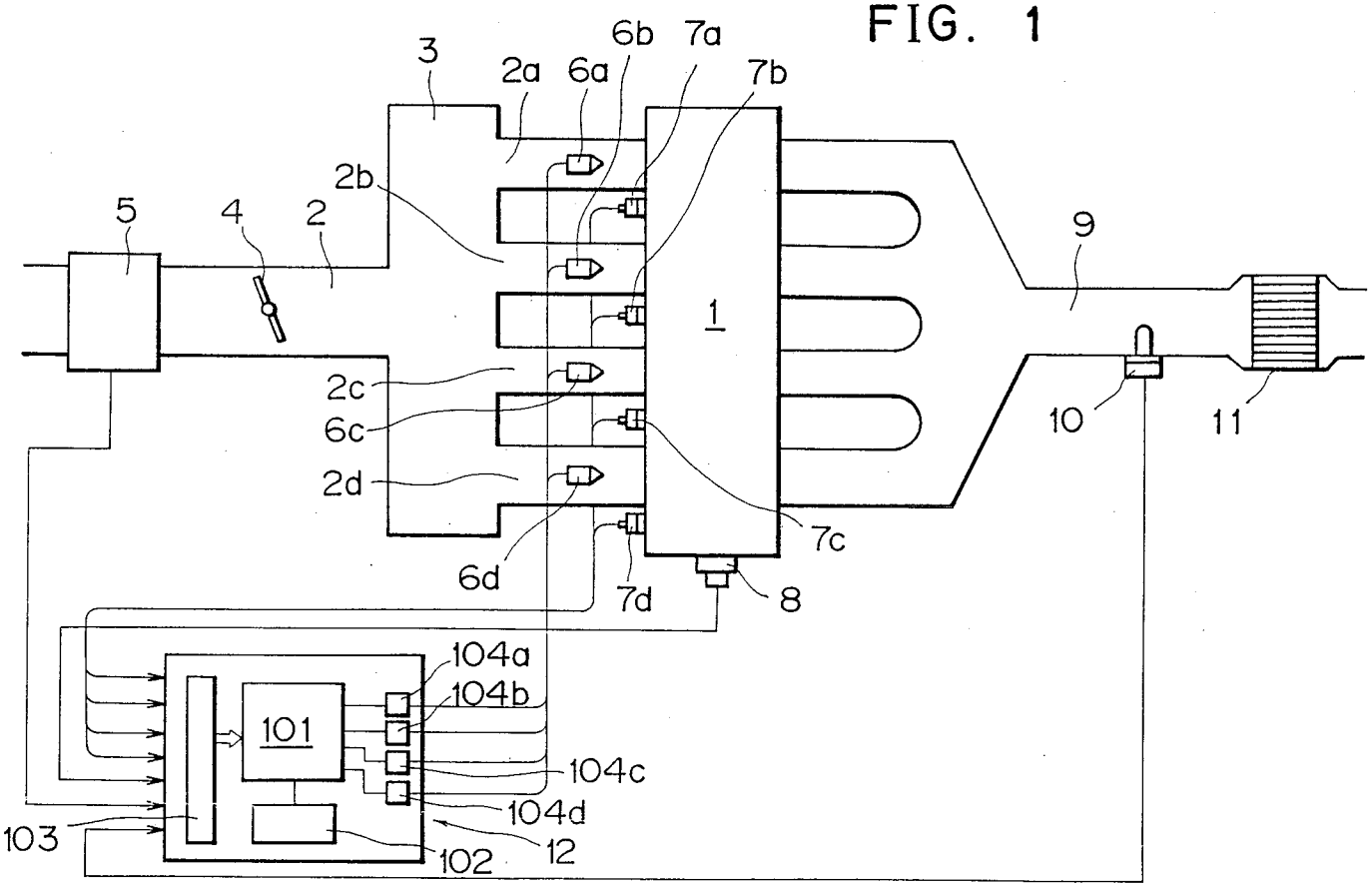
FIG. 1 illustrates an overall arrangement of a first embodiment of a control apparatus for an internal combustion engine according to the present invention.

FIG. 1 shows an overall view of a control apparatus according to the present invention. An engine 1 is assumed to be of a four-cylinder type in this embodiment. An intake passage 2 communicating with an air cleaner, not shown, is split into four air paths at the downstream of a surge tank 3 to form passages 2*a*, 2*b*, 2*c*, 2*d*, each of which being communicated with the intake port of each cylinder. A throttle valve 4 for adjusting the amount of air intake is provided at the upstream of a surge tank 3 in the intake passage 2. Upstream of the throttle valve 4 is provided an air flow sensor 5 for detecting the amount of air intake. The passages 2*a*–2*d* are provided with fuel injection valves 6*a*–6*d*, respectively, for controlling the air intake.

Within the respective combustion chambers are provided combustion pressure sensors 7*a*–7*d* for detecting combustion pressure of the respective cylinders. The engine body 1 is provided with a crank angle sensor 8 for detecting crank angles. At the downstream of an exhaust gas path 9 is provided an oxygen sensor 10, which serves as an air-to-fuel sensor, for detecting the density of oxygen in the exhausted gas. Further down stream of the oxygen sensor 10 is disposed a catalyst converter 11.

The openings of the fuel injection valves 6*a*–6*d* are controlled by a control unit 12 which is formed of a microprocessor 101, a memory 102, an input circuit 103, and fuel injection drive circuits 104*a*–104*d* for driving the fuel injection valves 6*a*–6*d*. The program for the control is stored in the memory 102.

The control unit 12 computes the pulse width of a basic fuel injection valve drive signal on the basis of the intake air signal outputted from the air flow sensor 5 and an engine speed calculated from a crank angle signal from the crank angle sensor 8, and then corrects the pulse width of the basic fuel injection valve drive signal in accordance with an air-to-fuel ratio signal outputted from the oxygen sensor 10 to thereby determine the ultimate pulse width of the fuel injection valve drive signal. The pulse width indicates the length of time for which the injection valves are opened and the fuel injection valve drive signal having the ultimate pulse width represents the air-to-fuel ratio of the cylinders with which the respective cylinders operate with least contamination of the exhaust gas. In this manner, the oxygen density in the exhaust gas is fed back to the control unit 12 for adjusting openings of the respective fuel injection valves to set the actual air-to-fuel ratio of each of the cylinders.

The control unit 12 makes a decision based on combustion pressure signals from the combustion pressure sensors 7*a*–7*d* whether or not the respective cylinder is misfired. Possible causes that may lead to misfiring include malfunction of firing devices, not shown, such as an ignition coil, igniters, high voltage cords, and firing plugs, loose contact of connectors that connect these firing devices, dirty firing plugs, malfunction of the fuel injection valve drive circuits 104*a*–104*d* that drive the fuel injection valves, and incomplete combustion of the fuel due to water leakage into the cylinders.

In the embodiment, the combustion pressures immediately before and after the compression top dead center are compared with each other for determining whether or not the relation in magnitude between the two pressures coincides with a predetermined pattern stored in the memory 102, thereby detecting the presence or absence or misfiring. When misfiring is detected, the misfiring cylinder is determined by the control unit 12 on the basis of the crank angle signal from the crank angle sensor 8. Then the control unit 12 manipulates the signal to be transmitted to the fuel injection valve drive circuit 104*a*–104*d* corresponding to the misfired cylinder so as to stop fuel delivery to the cylinder involved. That is, the control unit 12 serves as a drive stopping means.

Figure 2:
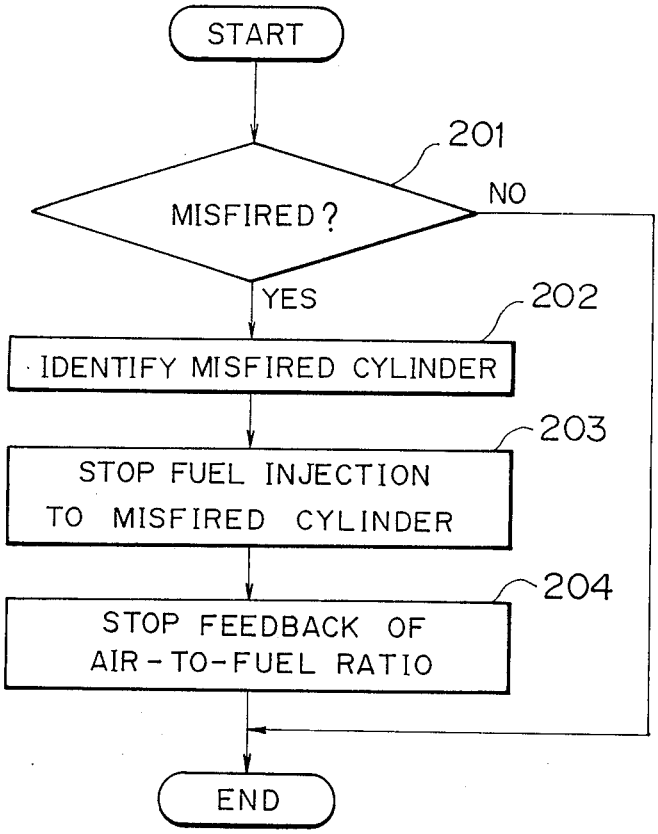
FIG. 2 is a flowchart for carrying out the control of the embodiment shown FIG. 1.

The control operation of the aforementioned embodiment will now be described with reference to a flowchart in FIG. 2. The control operation is carried out in accordance with the program stored in the memory 102.

At step 201, the cylinders are interrogated whether or not they are misfired. If a cylinder is misfired, then a decision is made at step 202 to determine which of the cylinders is misfired. Then, the fuel delivery to the misfired cylinder is stopped at step 203. Then the feedback to the remaining cylinders in accordance with the output of the oxygen sensor 10 is stopped at step 204. In other words, the remaining cylinders are now supplied the fuel thereto under an open loop control, where the air-to-fuel ratio feedback correction is not applied.

When the fuel delivery to the misfired cylinder is stopped, air containing a large amount of oxygen therein is directly discharged, causing the output from the oxygen sensor 10 to persistently stay at "lean side". Therefore, the actual air-to-fuel ratio of the normally fired cylinders will shift to "rich side". Thus when the cylinders are misfired, as described above, not only the fuel injection to the misfired cylinder is stopped but also the feedback correction to the cylinders normally operating is stopped. When all the cylinders are normally operating, the pulse width of the fuel injection valve drive signal which is calculated on the basis of the intake air and the engine speed or crank angle is feedback-corrected in accordance with the output signal of the oxygen sensor.

Figure 3:
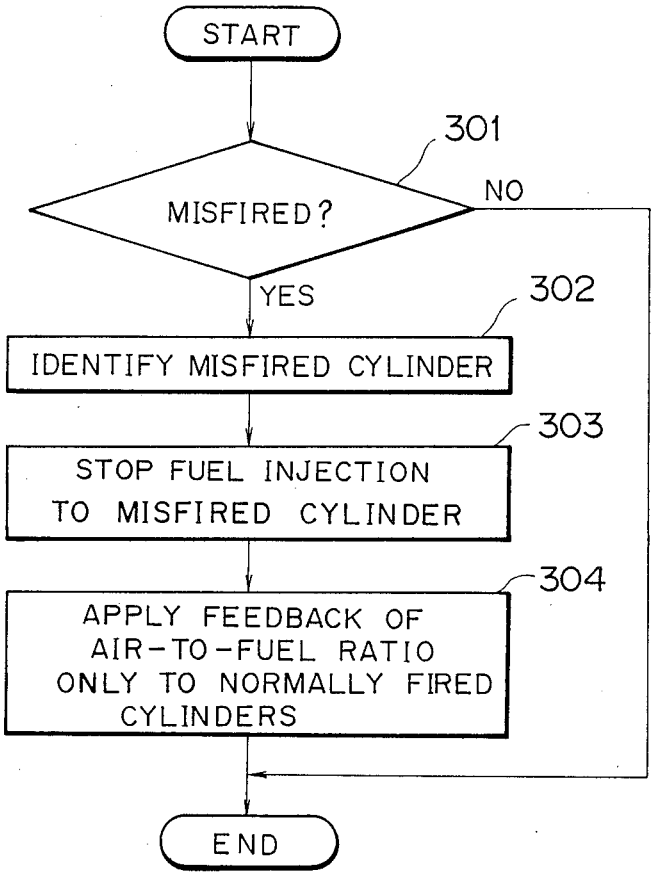
FIG. 3 is a flowchart for carrying out the control of a second embodiment of the invention.

FIG. 3 shows a second embodiment of the invention where the normally fired cylinders remain feedback-controlled. The operation of FIG. 3 is the same as that of FIG. 2 except that the feedback is not stopped when some of the cylinders are misfired.

In the first embodiment, when the cylinder is misfired, not only the fuel injection to the misfired cylinder is stopped but also the feedback correction to the cylinders normally operating is stopped. However, it the oxygen sensor is of a type in which the output thereof is substantially directly proportional to the oxygen density, the feedback control may still be applied so that the remaining cylinders operate with the same air-to-fuel ratio as that when all the cylinders are fired normally, in which case, the apparent air-to-fuel ratio of the cylinders is given by:

$$Lo=nQa/nQf=Qa/Qf$$

$$L=nQa/(n-p)Qf$$

therefore, $L=Lo\ n/(n-p)$

Where n is the number of cylinders, Qa is the amount of an intake air of the respective cylinder, Qf is the amount of fuel supply to the respective cylinder, Lo is the air-to-fuel ratio of the cylinders when all of the cylinders are normally operating, p is the number of misfired cylinders, and L is the apparent air-to-fuel ratio of the cylinders when p cylinders are misfired.

That is, setting the new desired value of the air-to-fuel ratio signal when one cylinder is misfired to a value $n/(n-1)$ times that when all the cylinders are normally operating can maintain the air-to-fuel ratio of the remaining cylinders at the value when all the cylinders are operating normally.

Conventionally, the feedback correction is set to a certain limit value to prevent engine troubles due to an unusual amount of feedback occurred for some reason. The limit value may be further limited to a smaller value when misfiring occurs.

While in the embodiment described, the combustion pressures at the two points immediately before and after the top dead center, are compared with each other to detect misfiring, such a way of detecting misfiring is only exemplary and other misfiring detection sensors may also be used.

The present invention can also be applied to a fuel injection control apparatus of the open loop control where no feedback control is involved.

Industrial Applicability

Even if some of the cylinders are misfired, the automobile can be driven to, for example, a repair shop without problems of contamination of the environment and overheat of and/or damage to the catalyst. Stopping fuel supply to the misfired cylinder and stopping the feedback control of the remaining cylinders permits to prevent overheat and deterioration of the catalyst and contamination of the exhausted gas as well as to prevent the normal cylinders from being controlled to "rich side" due to the fact that the oxygen sensor is exposed to an abnormally large amount of oxygen to persistently stay at "lean side".

What is claimed:

1. A control apparatus for an internal combustion engine, comprising:

(a) a plurality of fuel injection valves individually disposed in intake passages of an equal plurality of cylinders of the engine, (b) a plurality of combustion condition sensors individually associated with the cylinders, (c) a crank angle sensor mounted on the engine, (d) an air-to-fuel ratio sensor disposed in an exhaust passage of the engine, and (e) a control unit for:

(1) driving the fuel injection valves in a feedback control mode in accordance with the output of the air-to-fuel ratio sensor when all of the cylinders are firing normally, (2) processing the outputs of the combustion condition sensors and the crank angle sensor to detect the misfiring of a cylinder and to identify the misfiring cylinder, (3) terminating the drive of the fuel injection valve of an identified misfiring cylinder in response to a misfiring detection thereof, to attendantly terminate the supply of fuel to the misfiring cylinder, and (4) driving the fuel injection valves of the remaining, normally firing cylinders in an open loop control mode in response to a misfiring detection, said open loop control mode ignoring the detection of an abnormally high oxygen level by the air-to-fuel ratio sensor.

2. A control apparatus for an internal combustion engine, comprising:

(a) a plurality of fuel injection valves individually disposed in intake passages of an equal plurality of cylinders of the engine, (b) a plurality of combustion condition sensors individually associated with the cylinders, (c) a crank angle sensor mounted on the engine, (d) an air-to-fuel ratio sensor disposed in an exhaust passage of the engine, and (e) a control unit for:

(1) driving the fuel injection valves in a feedback control mode in accordance with the output of the air-to-fuel ratio sensor when all of the cylinders are firing normally, (2) processing the outputs of the combustion condition sensors and the crank angle sensor to detect the misfiring of a cylinder and to identify the misfiring cylinder, (3) terminating the drive of the fuel injection valve of an identified misfiring cylinder in response to an misfiring detection thereof, to attendantly terminate the supply of fuel to the misfiring cylinder, and (4) driving the fuel injection valves of the remaining, normally firing cylinders in an adjusted feedback control mode in accordance with the output of the air-to-fuel ratio sensor in response to a misfiring detection, said adjusted feedback control mode compensating for the detection of an abnormally high oxygen level by the air-to-fuel ratio sensor.

3. A control apparatus for an internal combustion engine according to claim 2, wherein said adjusted feedback control mode is carried out in accordance with an apparent value of the sensed air-to-fuel ratio given by: $L=nLo/(n-p)$, where L is said apparent value of the sensed air-to-fuel ratio, n is the number of cylinders, Lo is the sensed air-to-fuel ratio when all of the cylinders are normally firing, and p is the number of misfiring cylinders.

* * * * *